US006996862B1

(12) United States Patent
Shippy et al.

(10) Patent No.: US 6,996,862 B1
(45) Date of Patent: Feb. 14, 2006

(54) SHOWER CURTAIN DEFLECTOR

(76) Inventors: Joseph Shippy, 865 Ridgemont, Commerce, MI (US) 48382; John Shippy, 865 Ridgemont, Commerce, MI (US) 48382

( * ) Notice: Subject to any disclaimer, the term of this patent is extended or adjusted under 35 U.S.C. 154(b) by 0 days.

(21) Appl. No.: 11/011,976

(22) Filed: Dec. 15, 2004

(51) Int. Cl.
*A47K 3/22* (2006.01)

(52) U.S. Cl. ..... 4/610; 4/608; 4/558

(58) Field of Classification Search ..... 4/557, 4/558, 607–610
See application file for complete search history.

(56) References Cited

U.S. PATENT DOCUMENTS

| | | | | |
|---|---|---|---|---|
| 5,007,120 A | * | 4/1991 | Annand | 4/558 |
| 5,097,541 A | | 3/1992 | Annand | |
| 5,732,420 A | | 3/1998 | Micciche | |
| 5,771,504 A | | 6/1998 | Steiner | |
| 5,894,642 A | | 4/1999 | Eberhardt | |
| 6,098,699 A | | 8/2000 | Junius | |
| 6,766,848 B2 | | 7/2004 | Cheng | |
| 2001/0039677 A1 | | 11/2001 | Bryce | |
| 2002/0189011 A1 | | 12/2002 | Hess | |
| 2004/0007335 A1 | | 1/2004 | Cheng | |
| 2004/0107493 A1 | | 6/2004 | Orpilla | |

* cited by examiner

*Primary Examiner*—David J. Walczak
*Assistant Examiner*—Huyen Le
(74) *Attorney, Agent, or Firm*—Eric Hanscom

(57) ABSTRACT

A shower curtain deflector can be produced economically and installed easily without assembly. The deflector is of a simple design that attaches rotably to the shower curtain rod with an elongated portion which pushes the shower curtain away from the user due to counterweighted portion which hangs on the tub side of the shower curtain. Because the device hangs directly from the shower curtain support rod it is simple to install, does not interfere with a user's ability to get into the shower and leave the tub quickly, and does not pose a danger should the user fall against the curtain or have to push his/her way out through the curtain. A user only need use two units to effectively restrain the shower curtain. Because the device is small and simple, it is inexpensive and easy to manufacture and package.

6 Claims, 2 Drawing Sheets

SHOWER CURTAIN DEFLECTOR

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

This invention is directed toward a shower curtain deflector which can be produced economically and installed easily without assembly. The deflector is of a simple design that attaches rotably to the shower curtain rod with an elongated portion which pushes the shower curtain away from the user due to counterweighted portion which hangs on the tub side of the shower curtain. Because the device hangs directly from the shower curtain support rod it is simple to install, does not interfere with a user's ability to get into the shower and leave the tub quickly, and does not pose a danger should the user fall against the curtain or have to push his/her way out through the curtain. A user only need use two units to effectively restrain the shower curtain. Because the device is small and simple, it is inexpensive and easy to manufacture and package.

The use of tubs for bathing dates back to Merano Italy where there is evidence from more than 5000 years ago that human would use hot springs and try to contain them for bathing purposes. It appears that humans began to use showers as we know them today sometime later, in the early 1800's with the advent of indoor plumbing and water pressure, and the earliest shower curtain appears in the 1800's. Many bathtubs which contain showers are quite narrow, particularly older bathtubs. Over the same centuries in which humans have developed bathtubs and shower curtains, they have been evolving into a taller, and, unfortunately in most cases, a wider and heavier species. As a result, there is frequently very limited space for a human when he/she is using a shower.

Even in cases where the bathtub has been designed wide enough to comfortably house a human, an unweighted or freely hung shower curtain will often move inward, away from the shower edge and onto the human user due to the Bernoulli effect, which is a natural tendency of objects to move toward areas of low pressure caused by a fluid (water droplets from the shower) moving past at a high rate of speed. When a shower is on, the water droplets move in a relatively constant direction with considerable velocity. This causes the air particles caught in between the water droplets to be dragged along with the droplets away from the conical area defined by the moving droplets to the bottom or back of the tub, where there velocity of the water droplets stops as they hit porcelain or tile. The result is that there is a low pressure area in the conical area defined by the shower and since air will move from an area of relatively high pressure (outside of the cone) to an area of low pressure (inside the cone), there is a constant rush of air from the sides of the cone into the cone. Since many shower curtains seal well with the sides of the shower stall and the top of the bathtub, it is difficult for air to rush into the vacuum other than to "climb" over the shower curtain rod. Thus, there is an inward "pull" exerted on the shower curtain itself as the air between the shower curtain and the shower cone is sucked into the shower cone, thereby pulling the shower curtain into the void between the shower cone and the previously located shower curtain. This rather scientifically clinical and sterile sequence of events has the unpleasant result of having a cold and clammy shower curtain move against a shower user with distasteful results. Accordingly, there has existed a long-felt need for a device which not only provides additional showering space in a tub by moving the shower curtain away from the user, but also restrains the shower curtain to prevent the same from being pulled against a user due to the Bernoulli Effect.

There have been numerous attempts to design a shower curtain arrangement to prevent water spillage, including U.S. patent application No. 20020189001 to Hess, U.S. patent application No. 20040007335 to Cheng, U.S. patent application No. 200100039677 to Bryce, U.S. patent application No. 200401074973 to Orpilla, and U.S. Pat. No. 6,766,848 to Cheng. While all of these inventions teach some use of shower curtain, the inventions all deal with using the shower curtain in a unique manner to prevent water from escaping the tub enclosure and do not address the problem of a shower curtain which swings inward upon a user turning on the shower.

Also relevant are U.S. Pat. No. 5,894,642 to Eherhardt and U.S. Pat. No. 6,098,699 to Junius, both of which teach methods of hanging shower curtains. Again, while these patents add to the technology behind the hanging of shower curtains, neither teaches a solution to the problem addressed by this invention. The prior art does contain several examples of attempts to resolve the problem of a shower curtain swinging in toward a user while the show is one. For example, U.S. Pat. No. 5,771,504 to Steiner teaches an apparatus for use with a conventional bathtub which has multiple, semi-rigid ribs which are attached to both the shower curtain rod and the bathtub edge. The ribs bow out and are attached to the outer surface of the shower curtain, thereby causing the shower curtain to bow out along the contour lines established by the ribs. While this invention does effectively hold the shower back from swinging in against a user, it is, compared to the current invention, expensive, time consuming to assemble, difficult to package for retail, and hard to adjust. Indeed, the invention must be either partially dissembled or at least moved as unit to the side every time a user enters or leaves the bathtub. There is also a possible danger to the user should he or she have to leave the tub quickly as the ribs are not designed for easy removal; thus a user might end up breaking the ribs and possibly incurring cuts or impalements should he/she have to break through the ribs to leave the tub quickly.

Another invention which addresses the issue is U.S. Pat. No. 5,732,420 to Micciche, which teaches a horizontal rod stretched horizontally across the space a couple of feet above the outer edge of the tub. While this invention does provide a viable solution for the problem of a shower curtain moving in against a user, it is relatively cumbersome (the rod comes in two pieces, each attached to a "quasi-box brace structure" which is attached to the wall surrounding the tub, and to use the invention a user must attach the two parts of the rod together and then detach them and hang them along the sides of the tub to leave the tub). This invention is also, relative to the current invention, expensive, large, difficult to assemble, requires a user to make a permanent attachment to the walls on either side of the tub, and is difficult to package for retail sales. As with the '504 patent, this invention also presents a danger to the user should the user fall out of the tub or need to step out of the tub quickly, as he/she could fall over the horizontal bar.

A final attempt to solve this problem is found in U.S. Pat. No. 5,097,541 to Annand. This patent teaches a device which is attached along with the shower curtain to the rings hanging down from the shower curtain support rod. There is a weighted rod which is rotably attached to an elongated member which then pushes out against the shower curtain. While this device does appear to effectively restrain the shower curtain, it is, relative to the current invention, expensive, difficult to manufacture, package, and assemble, and from the figures attached appears to require more than two such units to function effectively.

Thus there has existed a long-felt need for a safe, easy to assemble, inexpensive device which keeps a shower curtain from swinging in and either decreasing the usable area during a shower, or, worse yet, touching the user with its cold, clammy surface and wrapping around the user's leg, and allows easy access and exits from the tub.

The current invention provides just such a solution by having a shower curtain deflector which can be produced economically and installed easily without assembly. The deflector is of a simple design that attaches rotably to the shower curtain rod with an elongated portion which pushes the shower curtain away from the user due to counter-weighted portion which hangs on the tub side of the shower curtain. Because the device hangs directly from the shower curtain support rod it is simple to install, does not interfere with a user's ability to get into the shower and leave the tub quickly, and does not pose a danger should the user fall against the curtain or have to push his/her way out through the curtain. A user only need use two units to effectively restrain the shower curtain. Because the device is small and simple, it is inexpensive and easy to manufacture and package.

SUMMARY OF THE INVENTION

It is a principal object of the invention to restrain a shower curtain from swinging in upon a user of a shower.

It is another object of the invention that such restraint can be accomplished using a mere two units of the invention.

It is an additional object of the invention that a user of a shower be able to fall through the shower curtain or quickly leave the shower by pushing through the shower curtain without sustaining injury due to the device which restrains the shower curtain.

It is a further object of the invention that the device be easily assembled and not require a user to attach any parts before use.

It is also an object of this invention that the device be quickly mounted on top of the shower curtain rod and not require that the device need be threaded through the rings by which the shower curtain is attached to the shower curtain rod.

It is a further object of this invention that a user of the invention be able to quickly and easy slide the shower curtain open and closed when entering and exiting the shower, without having to remove or adjust any device serving to deflect the shower curtain.

It is an additional object of the invention that the device be inexpensively manufactured due to its simple design.

It is a final object of this invention that the device be easy to package for retail sale due to its small size and simple design.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

Figure 1:
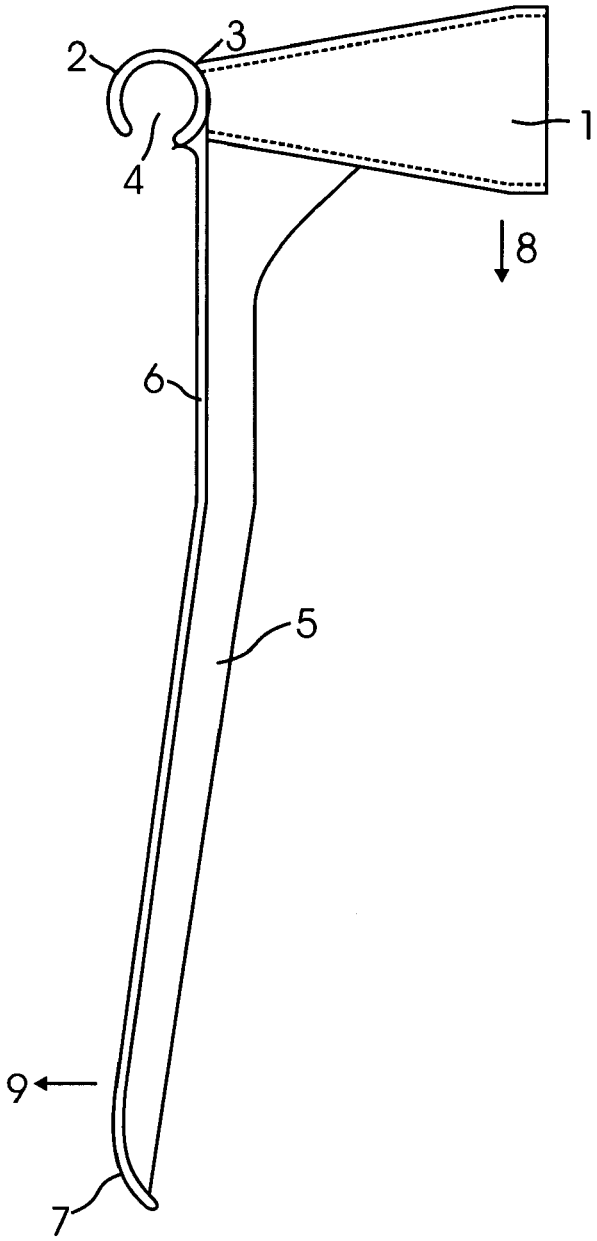
FIG. 1 is a side view of the invention showing the parts of the invention and how the counterweight forces the deflector surface of the invention to push against the shower curtain.

FIG. 1 is a side view of the invention showing the parts of the invention and how a counterweight (1) forces a deflector surface (6) of the invention to push against the shower curtain. Turning to the figure, the counterweight (1) is attached at an attachment point (3) by means of a screw (10) to a deflector portion, which consists of a shower curtain hanger (2), a deflector rib (5), a deflector surface (6), and a deflector terminus (7). The counterweight (1) is made of metal, plastic coasted metal, heavy plastic, or some other material which is heavy and will not corrode or degrade when subjected to frequently contact to water, and can be manufactured as a sphere, cone, or other shape. The deflector portion is made of a sturdy plastic, fiberglass, or other sturdy yet light material which is easily molded and yet flexible enough to snap over the shower curtain repeatedly without losing its semi-rigidity. The shower curtain hanger (2) has an open section (4) which allows it to snap over a shower curtain rod. The deflector rib (5) is an elongated member which supports the deflector surface (6) and helps to maintain the structural integrity of the deflector portion. Toward the bottom of the invention, the deflector surface (6) curves slightly inward and broadens to the form the deflector terminus (7) which is the portion of the deflector surface which comes into the most forcible contact with the shower curtain. The enlarged surface area and gently curved surface of the deflector terminus (7) allows it to accomplish its goal of pushing the shower curtain out from the edge of the bathtub, away from the user of the shower, in a manner which will, over many uses, cause minimal harm to the shower curtain. The invention is attached to a shower curtain rod such that the counterweight (1) is located on the inside of the shower stall and, due to gravity, pulls down in a direction (8). The deflector surface (6) is, in turn, pushed in a direction (9) and pushes the shower curtain out, away from the user.

Figure 2:
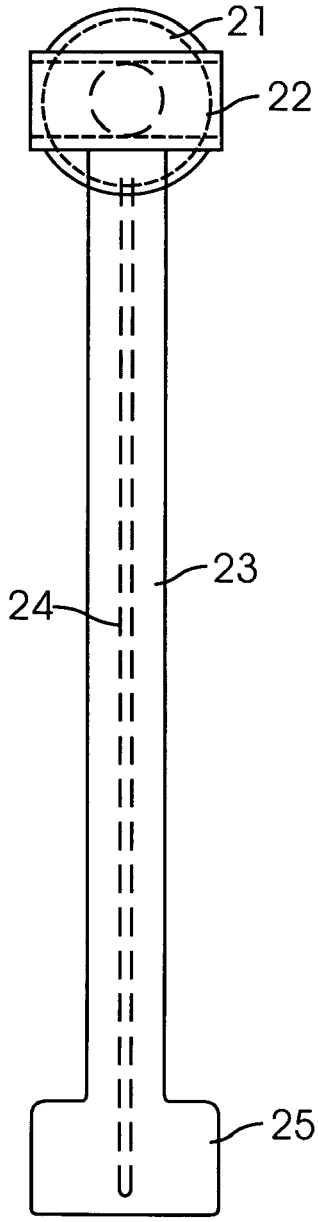
FIG. 2 is a front view of the invention which illustrates how the deflector surface is enlarged at the deflector terminus.

FIG. 2 is a front view of the invention which illustrates how the deflector surface is enlarged at the deflector terminus. Here, the counterweight (21) is of a diameter narrower than the shower curtain hanger (22), which allows the deflector rib (23) to stay relatively vertical to perform its function. Had the shower curtain hanger (22) be made more narrowly, there would be a tendency of the invention to sway back and forth during use, thereby causing abrasion to the shower curtain where it is deflected by the deflector surface (23) and particularly at the deflector terminus (25).

Figure 3:
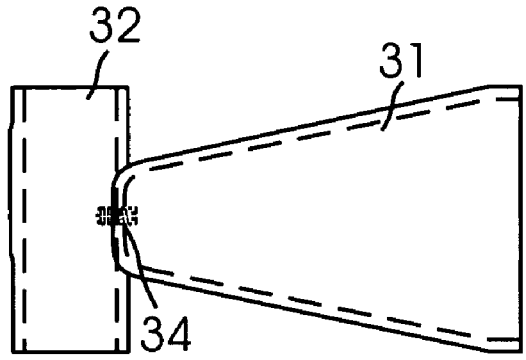
FIG. 3 is a top, cut-away view of the invention at it uppermost portion, showing how the counterweight is attached to the deflector portion.

FIG. 3 is a top, cut-away view of the invention at it uppermost portion, showing how the counterweight (31) is attached to the deflector portion. There is a screw (34) which slides through a bore in the counterweight (31) into a plastic cavity (35) manufactured into the connection point (33) to the deflector portion, the only part of which shown here is the curtain hanger (32). The plastic cavity (35) is of a diameter smaller than the screw (34), which is made of stainless steel, hardened plastic or some other waterproof material, such that when the unit is manufactured, the technician need only drive the screw (34) into the plastic cavity (35) to attach the counterweight (31) to the deflector portion of the invention. Note how the screw (34) fits into a countersunk portion of the counterweight (31) such that it does not protrude from the invention.

Figure 4:
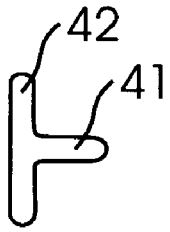
FIG. 4 is a top, cut-away view of the invention showing the size relationship between the deflector rib and the deflector surface approximately halfway down the deflector portion toward the deflector terminus.

FIG. 4 is a top, cut-away view of the invention showing the size relationship between the deflector rib (41) and the deflector surface (42) approximately halfway down the deflector portion toward the deflector terminus. In this figure, the deflector rib (41) is substantially wider than the deflector surface (42), as at this part of the invention maintaining the structure integrity is more important than having a large surface area to deflect the shower curtain.

Figure 5:
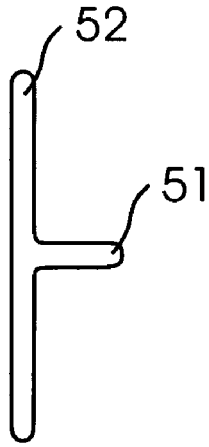
FIG. 5 is a top, cut-away view of the invention showing the size relationship between the deflector rib and the deflector surface at the deflector terminus.

FIG. 5 is a top, cut-away view of the invention showing the size relationship between the deflector rib (51) and the deflector surface (52) at the deflector terminus. This portion of the invention is where the major restraint and deflection of the shower curtain occurs, so the deflector surface (52) is large and wide compared to the deflector rib (51). The relatively large surface area of the deflector surface (52) allows it to push out the shower curtain with considerable force, and yet dissipate this force over a large enough surface area such that any damage, over time, to the shower curtain is minimized.

What is claimed is:

1. A device for deflecting a shower curtain, comprising:

a counterweight, and, a deflector portion, where, the counterweight is attached to the deflector portion at a connection point by a screw, which is made of stainless steel metal, strong plastic, or some other waterproof means of attachment, through a countersunk bore in the counterweight, and, the deflector portion comprises a deflector rib and a deflector surface, where, the deflector rib is an elongated member which extends at approximately a 90 degree angle from the counterweight and curves gently inward, and, where, the deflector surface is flat and follows the curves of the deflector rib such that as the counterweight pulls in a downward direct due to gravity, an equal and opposite force is exerted on the deflector portion, causing it to push gently but firmly against a shower curtain such that the shower curtain is pushed outward, away from the shower and the user of the shower, in a manner which is safe for the user in that the user can quickly exit the shower or even fall through the shower curtain with having to push away or break through an shower curtain deflector devices, and that a user can easily open and close the shower curtain to enter or exit the shower enclosure by merely pushing the shower curtain and the device back and forth without the necessity of having to attach or detach any part of the device and where, the device rests on the shower curtain rod and does not require a user to attach it to or through the shower curtain rod rings.

2. The device of claim 1, where, the counterweight is a sphere.

3. The device of claim 1, where, the counterweight is of a conical shape.

4. The device of claim 1, where, at the end of the deflector portion furthest away from the counterweight is a deflector terminus which comprises a narrowed deflector rib and an enlarged deflector surface, where, the deflector rib gently curves back, away from the place of contact with the shower curtain, such that the enlarged surface area of the deflector surface combined with its following of the gently curvature of the deflector rib provides a relatively large body without sharp edges to deflect the shower curtain such that any wear and tear on the shower curtain over many uses of the device is minimized.

5. The device of claim 4, where, the counterweight is a sphere.

6. The device of claim 4, where, the counterweight is of a conical shape.

* * * * *